United States Patent [19]

Hoyer et al.

[11] 4,137,076

[45] Jan. 30, 1979

[54] ELECTRICAL CONTACT MATERIAL OF TiC, WC AND SILVER

[75] Inventors: Norman S. Hoyer; Paul G. Slade; Ram Kossowsky, all of Pittsburgh, Pa.

[73] Assignee: Westinghouse Electric Corp., Pittsburgh, Pa.

[21] Appl. No.: 771,430

[22] Filed: Feb. 24, 1977

[51] Int. Cl.[2] ..... H01H 1/02; B22F 5/00

[52] U.S. Cl. ..... 75/241; 200/264; 200/265; 200/266; 200/270; 428/545; 428/929

[58] Field of Search ..... 428/544–546, 428/548, 929; 75/228, 236, 241; 200/264, 265, 270, 266

[56] References Cited

U.S. PATENT DOCUMENTS

| | | | |
|---|---|---|---|
| 2,768,099 | 10/1956 | Hoyer | 75/203 |
| 3,482,950 | 12/1969 | Kosco | 29/182.8 |
| 3,985,512 | 10/1976 | Hassler et al. | 428/545 |

*Primary Examiner*—Brooks H. Hunt
*Attorney, Agent, or Firm*—R. T. Randig

[57] ABSTRACT

An electrical contact suitable for use in high-current switching or circuit breaking, comprising a mixture of silver or copper with an alloy of tungsten carbide and titanium carbide. The contact material preferably uses from about 10% to about 90% silver by weight, the remainder being (WTi)C alloy, and preferably the alloy component comprises from about 35% to about 50% of WC, the remainder of the alloy being TiC. The contact is preferably made by a powder metallurgical process, and provides not only good impact resistance, weld resistance and erosion resistance but, even more importantly, provides low contact resistance, i.e. low electrical resistance when current flows through the closed contacts even after repeated cycling, as shown by the low temperature rise of the contact in use.

5 Claims, 7 Drawing Figures

ELECTRICAL CONTACT MATERIAL OF TIC, WC AND SILVER

BACKGROUND OF THE INVENTION

It is known to use special alloys or mixtures of materials to form an electrical contact for the switching and/or breaking of electrical circuits. Certain elements, such as silver and copper, are known to be excellent electrical conductors, and have been used in elemental form in contacts for handling small currents. However, they are not suitable for general use in handling high currents, e.g. from hundreds to thousands of amperes. This is because, while such metals exhibit very low electrical resistance, they do not provide the combination of impact resistance, weld resistance and arc erosion resistance over long periods of use which are important in practical high-current applications.

Accordingly, various mixtures of compounds and/or elements have been proposed and used for practical high-current switching and circuit breaking. Among such proposed contact materials are: a mixture of Ag or Cu, plus Mo or W, plus Ni and TiC (U.S. Pat. No. 3,482,950 of J. D. Kosco, issued Dec. 9, 1969); a mixture of Ag with a metal selected from Ti, Mo, W or Si, and with a carbide of the latter metal (U.S. Pat. No. 3,225,169 of J. C. Kosco, issued Dec. 21, 1965); a mixture of TiC and Ag (U.S. Pat. No. 2,978,641 of R. M. Atkinson, issued Sept. 5, 1961); a mixture of Co, Ag and a carbide of Ti, Zr, V, Cb, Ta, Mo, or W (U.S. Pat. No. 1,984,203 of G. N. Sieger, issued Dec. 11, 1934); a mixture of Ag with WC, Ni or CdO (U.S. Pat. No. 2,390,595 of E. I. Larsen et al, issued Dec. 11, 1945); a mixture of Ag with Si and any of W, Mo and their carbides; Ag or Cu mixed with W and/or Mo and/or their carbides (U.S. Pat. No. 2,768,099 of N. S. Hoyer); and various others.

However, there are applications in which, so far as is known to applicants, no previously-known economical contact material has proved entirely satisfactory from all viewpoints. For example, silver-cadmium oxide mixtures have been used for high current contacts, in which the CdO is present as a fine dispersion of hard particles in the predominantly silver contact, but the cost of such contacts is generally quite high. Ag-W mixtures have been used as contacts in circuit breakers for high currents and provide good weld resistance and good arc-erosion resistance, but tend to deteriorate substantially over extensive periods of use, particularly with respect to increases in contact resistances due to excessive formation of silver tungstate, which acts as an insulating oxide.

Ag-TiC mixtures are also known for use in electrical contacts, but are generally lacking in strength (impact resistance) and rather difficult to make, in part due to difficulty in wetting TiC with Ag.

Accordingly, it is an object of the invention to provide a new and useful composition of an electrical contact member.

Another object is to provide such a contact member which exhibits good impact resistance, good weld resistance, low erosion rate, and low contact resistance even after long periods of use at high currents, and yet is relatively inexpensive.

SUMMARY OF THE INVENTION

In accordance with the invention, these and other objects are achieved by the provision of an electrical contact member containing a material comprising a mixture of silver or copper with an alloy of tungsten carbide and titanium carbide. The copper or silver provides the basis for the low electrical resistance desired, while the alloy, being hard, refractory, and easily wetted by the copper or silver metal, provides good impact resistance and weld resistance as well as relative ease of fabrication. Importantly, the contact also maintains its low electrical resistance characteristics over long periods of time and during many cycles of opening and closing of the contact, even with high currents passing through it, and is superior to Ag-W in this respect. It is believed that this is due in large measure to the fact that the titanium in the contact does not readily form silver titanate with the silver metal, and the replacement of a substantial part of the tungsten by titanium means that there is less tungsten present to form the undesirable tungstate. Accordingly, the low resistivity metal remains in conductive form on the surface of the contact, as desired for good electrical conductance.

Preferred features include: use of silver as the low-resistivity metal; use of from about 10% to about 90% silver by weight in the contact mixture (preferably about 50%); and use of up to about 50% WC by weight in the alloy (preferably from about 35% to about 50% WC). Preferably also, the contact member is made by compacting and sintering a mixture of a powder of the alloy with a powder of the silver or copper metal, with later infiltration of the sintered mass by an additional quantity of the silver or copper.

BRIEF DESCRIPTION OF FIGURES

These and other objects and features of the invention will be more readily understood from a consideration of the following detailed description taken together with the accompanying drawings, in which.

DETAILED DESCRIPTION OF SPECIFIC EMBODIMENTS

Figure 1:
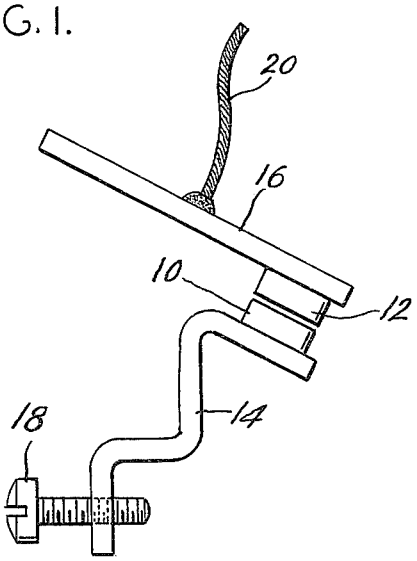
FIG. 1 is a side elevational view of contact apparatus including contact members made of the material of the invention.

In FIG. 1 there are shown a pair of electrical contact members 10 and 12, secured by brazing to a corresponding pair of conductive contact support arms 14 and 16. Arms 14 and 16 are movable with respect to each other, to enable controlled opening and closing of the contacts, the contacts being shown in FIG. 1 in their open position. In this example, arm 14 may be a copper strip, stationarily supported on fixed conductive terminal 18, while arm 16 may also be a copper strip electrically connected to a copper current-supplying wire 20. Arm 16 is movably supported by conventional means (not shown) to effect switch opening and closing. Voltage is applied between the contacts by way of terminal 18 and wire 20, whereby a current flows through the contacts in series when they are closed.

At least one, and preferably both, of the contacts 10 and 12 are made and constituted according to the present invention, a representative embodiment of which contacts will now be described.

In one example of a preferred form of the invention, the contact member consists essentially of silver mixed with an alloy of WC and TiC, herein designated as (WTi)C. As an example only, the contact member may consist essentially of silver mixed with an alloy of 50% WC and 50% TiC by weight, in which mixture silver constitutes about 50% and the (WTi)C alloy constitutes about 50%, by weight. It is believed that the alloy is a true solid-state solution alloy; the term "solid-state solution alloy" is used herein to designate an alloy in which the components are interspersed substantially homogeneously on an atomic level, as opposed to a mass of mixed material in which there exists agglomerations of a single component of the mixture, even if only on a microscopic level.

Figure 2:
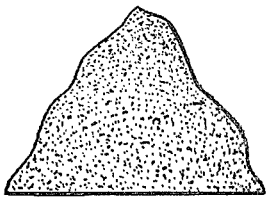
FIGS. 2 through 7 are schematic elevational views showing the contact of the invention in six successive stages of its fabrication.
Figure 3:
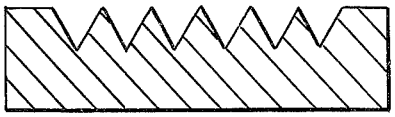
Figure 4:
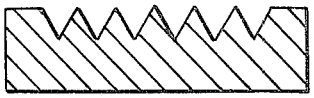
Figure 5:
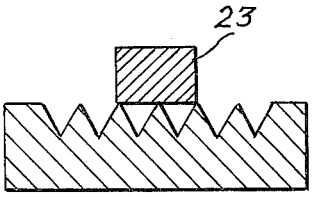
Figure 6:
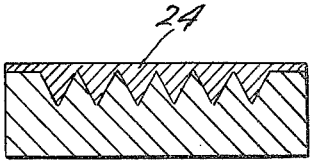
Figure 7:
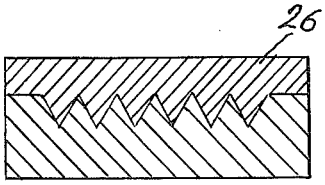

In this example, such a contact member has been made by a powder metallurgy process, as follows:

Commercial-grade alloy of 50% WC and 50% TiC is obtained in the open market, where it is sold for use in cutting tools and in wear-resistant components. This alloy, as obtained, is in the form of micron-sized particles, and is then thoroughly mixed with silver powder also having a particle size in the micron range. The proportions in the mixture are preferably about 65% alloy powder to about 35% of the silver powder, by weight. Standard techniques for adding a lubricant to the mixed powders may be employed to improve flowing characteristics or to provide die wall lubrication, but in general are not absolutely necessary for the present purposes. A portion of the mixed powder, represented in FIG. 2, is placed in a conventional die and subjected to high pressure, for example about 40 tons per square inch. The die is configured to provide the round pellet of FIG. 3, with a serrated area on its upper surface. The pressed part is then preferably sintered at about 1260° C. in a reducing atmosphere, for about one hour, to produce the similar but somewhat smaller pellet of FIG. 4. The sintered pellet is then infiltrated with fine silver, applied in the form of a slug as shown in FIG. 5, in a dry reducing atmosphere. The infiltration time is typically about ten minutes, the time used being a function of the mass of the sintered product. The resultant infiltrated pellet, shown in FIG. 6, should be substantially homogeneous with respect to the distribution of the infiltrating silver, and such as to produce a density of from about 96% to about 98% of the theoretical density of the product. The amount of silver infiltrated is preferably enough so that the total silver content in the contact material at the completion of infiltration is about 50% by weight. Excess pure silver normally remains as a layer (24 in FIG. 6) on the top surface of the pellet. To facilitate brazing of the contact to the arm 14, a layer of a suitable solder may be applied to the silvered top of the pellet, and momentarily melted and resolidified to form the solder layer 26 (FIG. 7). While this method of manufacture is preferred, quite different methods may be used if desired.

A pair of contacts made as described above was tested for switching performance and for circuit breaker performance in a 20 ampere quicklag circuit breaker, and compared with similar tests of conventional Ag-W contacts. The switching tests were made with a current of 20 amperes passing through the two contacts when closed, and also after opening and closing the contacts six times a minute. The circuit breaking tests were made with 5,000 amperes through the contacts.

More particularly, typical prior-art Ag-W contacts and the contacts of the invention were tested for switching performance in a circuit breaker by connecting a thermocouple to the supporting arm for the stationary contact to measure the temperature rise above the ambient temperature. The circuit breaker was placed in a 20-ampere, 120 volt, 90% power factor circuit, and the breaker closed with 20 amperes passing through the contacts until the measured temperature reached a steady state. The breaker was then operated to make and break the circuit 6 times a minute, switching the 20-ampere current, and measurements of temperature rise above ambient were made after 500, 1,000, 2,000, 3,000, 4,000, 5,000 and 6,000 operations. That is, before any switching (zero operations) several measurements of temperature rise were made; then 500 cycles of operation were performed, after which the contacts were left closed for 30 minutes and a group of temperature measurements made; and similarly after 1,000, 2,000, 3,000, 4,000, 5,000 and 6,000 operations.

The switching performance so measured for the (WTi)C-Ag is shown by the data in Table 1.

While Table 1 shows the variability to be expected from a circuit breaker system, it is noted that a temperature rise greater than 50° C. was measured only 1 time, i.e. less than 1% of the time, one standard criterion for failure for this type of breaker. It is also noted that the average temperature rise was always less than about 26.5° C.

Comparable results of similar tests for similar prior-art Ag-W contacts were as shown in Table 2.

In the tests shown in Table 2 for the prior-art Ag-W contacts, the average temperature rise was always higher than for the (WTi)C-Ag, except at zero cycles of operation. The probability of a more-than-50° C. temperature rise with the Ag-W contact was 27%, and the ranges of temperature rise included values as high as 86° C., showing performance much inferior to that of the (WTi)C-Ag contacts of the invention.

Tests of short-circuit performance were also made on three circuit breakers using the contacts of the invention, according to standard test procedures.

TABLE 1

| Operations | Temperature Rise Above Ambient At Contact Terminal, ° C | Average | Range |
|---|---|---|---|
| 0 | 36, 23, 20.5, 20.5 | 25 | 20.5–36 |
| 500 | 18, 24, 38.5, 44, 18, 32.5, 27, 16, 19, 34, 24, 23.5 | 26.5 | 16–38.5 |
| 1000 | 22, 21, 21, 15, 17, 33, 31, 30, 40, 55, 13, 19, 24.5, 25, 17, 10, 18, 12, 9, 20, 13 | 22.2 | 9–55 |
| 2000 | 22.5, 23, 24, 22, 24, 20, 25.5, 23.5, 21, 19, 22, 22 | 22.4 | 19–25.5 |
| 3000 | 15, 12, 10, 16, 18, 11, 16, 18, 11, 15, 17.5, 16, 15, 16, 20, 19, 18, 18, 21, 19, 18 | 16.2 | 10–19 |
| 4000 | 25, 27, 27, 28, 24, 27, 26, 26, 22.5, 24, 23, 23 | 25.2 | 22.5–28 |
| 5000 | 18.5, 21, 18.5, 12, 19, 21, 20, 19, 17, 20, 17, 12 | 17.9 | 12–21 |
| 6000 | 18, 20, 17.5, 17, 21, 23.5, 23, 22, 18, 19.5, 18.5, 18 | 19.7 | 17–23.5 |

TABLE 2

| Operations | Temperature Rise Above Ambient At Contact Terminal, ° C | Average | Range |
|---|---|---|---|
| 0 | 13, 12, 16, 21, 25, 15, 13, 13, 10 | 15.55 | 10–25 |
| 500 | 26, 14, 16, 75, 30, 37, 25, 21, 21 | 29.4 | 14–75 |
| 1000 | 32, 14, 16, 86, 31, 19, 44, 51, 31, 29,24, 22 | 33.3 | 14–86 |
| 2000 | 63, 14, 16, 63, 65, 63, 57, 44, 35, 50, 48, 32 | 45.8 | 14–65 |

TABLE 2-continued

| Operations | Temperature Rise Above Ambient At Contact Terminal, ° C | Average | Range |
|---|---|---|---|
| 3000 | 68, 22, 23, 65, 36, 53, 83, 51, 49 | 50.0 | 22–83 |

All three passed the tests with no severe erosion, and the breakers were still operable; the erosion was approximately comparable to that for Ag-W contacts with the same proportion of silver as in the (WTi)C-Ag contacts.

The proportions of the various components in the contact member of the invention may be varied substantially from those used in the example above. As to the proportions of silver in the contact, while in the example given above it is preferred to use about 50% by weight of silver in the contact, in other applications it may be advantageous to use anywhere from about 10% to about 90% of silver in the final contact. As to the proportions of WC and TiC in the alloy, while it is preferred to use an alloy which is from about 35% to about 50% WC, lesser or greater amounts may be used in particular applications. Also, while silver is preferred for the material of high electrical conductivity in the contact, other materials and particularly copper may be used in other applications of the invention, the contact being made by a process analogous to that described above.

In the form of the invention described by way of example, the contact consists substantially only of the silver or copper mixed with the (WTi)C alloy. However, it will be understood that other materials not substantially changing the contact performance may be present, mixed with the (WTi)C alloy, such as nickel, carbon, silicon, copper, cobalt, iron, cadmium, antimony, tin or others. The silver-or-copper mixture with (WTi)C may also be mixed with other materials which enhance or substantially modify the contact performance and characteristics.

The contact member of the invention may be used not only in breakers, but in all varieties of electrical contacting devices and contactors.

The alloy (WTi)C used in the contact member of the invention is typically produced by heating W, Ti and C in contact with each other in small-particle form, to an extent that alloying rather than mere sintering is produced. It is believed the particles do not melt in this process, and that the alloying is produced instead by solid-state interdiffusion between the particles of the components, the particles being so small that even a relatively small penetration by diffusion is sufficient to convert the particles to the alloy form.

Accordingly, while the invention has been described in detail with respect to specific embodiments in the interest of complete definiteness, it will be understood that it can be embodied in a variety of forms diverse from those specifically shown and described, without departing from the spirit and scope of the invention as reflected in the appended claims.

We claim:

1. A contact material comprising a skeleton of a solid-state solution alloy consisting essentially of tungsten carbide and titanium carbide in which the tungsten carbide is present within the range of about 30% and about 50% by weight of the skeleton of the contact material and the balance of the contact material comprising a metal of high heat and electrical conductivity, said latter metal being present within the range between about 10% and 90% by weight of the contact material.

2. The contact material of claim 1 in which the high heat and electrical conductivity metal is selected from the group consisting of copper and silver.

3. The contact material of claim 1 in which the solid-state solution alloy is present in an amount of about 50% by weight of the contact material and the balance of the contact material consists essentially of a metal selected from the group consisting of silver and copper.

4. The contact material of claim 1 in which the solid-state solution alloy is present in an amount of about 50% by weight of the contact material and tungsten carbide is present in an amount of about 50% by weight of the solid-state solution alloy, the balance of the contact material comprising a metal selected from the group consisting of silver and copper.

5. A contact material comprising a solid-state solution alloy skeleton of refractory metal carbides and a metal of high electrical and heat conductivity interspersed within the skeletal interstices.

* * * * *